US007111534B1

(12) United States Patent
Simpson

(10) Patent No.: US 7,111,534 B1
(45) Date of Patent: Sep. 26, 2006

(54) RESILIENT SCRAP STRIPPER FOR A CORRUGATED BOARD ROTARY CUTTING DIE

(75) Inventor: Jack Richard Simpson, Raleigh, NC (US)

(73) Assignee: Container Graphics Corporation, Cary, NC (US)

( * ) Notice: Subject to any disclaimer, the term of this patent is extended or adjusted under 35 U.S.C. 154(b) by 485 days.

(21) Appl. No.: 09/054,565

(22) Filed: Apr. 3, 1998

(51) Int. Cl.
*B26D 1/62* (2006.01)
*B26D 7/18* (2006.01)

(52) U.S. Cl. ..... 83/27; 83/117

(58) Field of Classification Search ..... 83/27, 83/23, 26, 117, 118, 119, 138, 139, 140, 141, 83/112, 128, 563; 493/82, 83, 342, 373, 493/472

See application file for complete search history.

(56) References Cited

U.S. PATENT DOCUMENTS 2,338,132 A * 1/1944 Sandberg ..... 83/118 X
2,402,223 A * 6/1946 Wright ..... 166/173
3,552,244 A * 1/1971 Smith, Jr. ..... 83/27 X
3,827,322 A * 8/1974 Saunders et al. ..... 83/139 X
3,946,627 A * 3/1976 Hofmann ..... 83/117
4,499,802 A * 2/1985 Simpson ..... 83/117
4,561,334 A * 12/1985 Sarka ..... 83/27
5,111,725 A * 5/1992 Simpson et al. ..... 83/117
5,161,442 A * 11/1992 Rilitz et al. ..... 83/117
5,363,728 A * 11/1994 Elsner et al. ..... 83/23
5,636,559 A * 6/1997 Smithwick, Jr. et al. .. 83/139 X
5,701,789 A * 12/1997 Okonski ..... 83/128 X
5,881,620 A * 3/1999 Smithwick, Jr. et al. .. 83/128 X

* cited by examiner

*Primary Examiner*—Charles Goodman
(74) *Attorney, Agent, or Firm*—Coats & Bennett, P.L.L.C.

(57) ABSTRACT

The present invention entails a rotary cutting die having one or more scrap strippers secured thereon for stripping scrap corrugated board pieces from adjacently disposed scrap cutting blades during a corrugated board die cutting operation. Each scrap stripper comprises a resilient member having a base and an angled flexible finger extending from the base so as to define an open area between the angled finger and the base. During a die cutting operation, the entire scrap stripper including the angled finger and base is compressed as the stripper passes through the nip defined between the cutting die and an associated anvil. As the stripper exits the nip, it expands causing the underlying scrap piece to be stripped from adjacently disposed blades. In addition, the angled finger extending from the base extends outwardly and engages the underlying cut piece of scrap and pushes or urges the cut scrap against the underlying anvil. The anvil, in turn, then directs the cut scrap piece downwardly and that action effectively separates the cut scrap piece from the finished corrugated board product exiting the nip.

12 Claims, 6 Drawing Sheets

RESILIENT SCRAP STRIPPER FOR A CORRUGATED BOARD ROTARY CUTTING DIE

FIELD OF THE INVENTION

The present invention relates to rotary cutting dies for cutting corrugated board and the stripping of scrap therefrom, and more particularly to a resilient stripping member for efficiently separating scrap material from an associated product blank and effectively controlling the exit trajectory of the scrap from the cutting die apparatus.

BACKGROUND OF THE INVENTION

Rotary or drum-type cutting dies are commonly used for producing a container or carton blank from corrugated board sheet material. Such rotary dies are typically comprised of a pair of cooperating cylinders or drums. One of the cylinders, a cutting cylinder, includes a die board having cutting blades or rules while the other, the anvil cylinder, provides a backing surface against which the cut is made.

Rotary cutting dies of the type described above are often employed to produce slots or various shaped openings in the blank sheet of corrugated board material that is being processed. As such, provisions for removing or stripping the severed scrap material from certain cutting blades and the processed blank must be provided. Otherwise, if not actively removed from the vicinity of the cutting die, the scrap material tends to collect around the cutting blades and, render the rotary cutting die inoperable.

Equally important, with regard to the stripping or ejection of scrap material, is the direction in which the successfully stripped or ejected scrap exits the cutting die apparatus. As the usable product of the cutting process is typically expelled directly outward from the nip of the rotary cutting die apparatus, it is desirable, in order to obtain complete separation of scrap and corrugated board product, that the scrap be ejected from the rotating cylinders at a significantly different trajectory than the corrugated board product.

In the past, resilient rubber strips or pads made of closed cell, high density foam or gum rubber have been placed adjacent the cutting blade so as to forcibly eject the corrugated board scrap material. However, previous resilient strippers have suffered from a number of shortcomings, particularly with regard to directional control of the ejected scrap material. First, it should be noted that scrap strippers of the prior art do not typically extend substantially past adjacently disposed scrap cutting blades even when in a non-compressed posture. Thus, while these scrap strippers may possess enough resiliency and strength to strip cut scrap pieces from the adjacent blades, they do not have the ability to significantly play a major role in controlling the direction and flight of scrap pieces exiting the nip between the rotating cutting die and the anvil. Thus, one typically finds cut scrap flying outwardly and sometimes upwardly out of the nip. The net result is that the scrap becomes airborne and intermingled with the exiting corrugated board product and ultimately becomes packaged with the supposedly clean product. Obviously, scrap intermixed with the final corrugated product is most undesirable, especially in certain industries and certain cases such as with pizza containers, for example.

Therefore, it has been found that conventional scrap strippers are incapable of extending or achieving a height that enables them to exercise control over the flight or trajectory of the exiting scrap pieces. Again, this is because in typical applications, the relatively hard rubber stripper pads when expanded (non-compressed) just barely extends in height past the adjacent scrap blade or blades and, as such, they cannot, in reality, significantly affect the flight path of the scrap pieces exiting the nip.

Therefore, there remains a need for a practical, reliable, and cost effective resilient scrap stripping member for use with corrugated board rotary cutting dies which efficiently separates severed scrap material from an associated blank of corrugated board material and which furthermore provides control of the ejected or stripped scrap trajectory as it exits the rotary cutting die apparatus.

SUMMARY OF THE INVENTION

The present invention recognizes that in order for a resilient foam or rubber scrap stripper to provide effective directional control of the ejected scrap material, they must act so as to hold the cut scrap against the associated anvil at least momentarily as the cut scrap pieces exit the nip between the rotary cutting die board and the anvil. By doing so, the scrap will be ejected by the rotating anvil in a direction that is significantly different from the direction of the ejected product. That is, by holding the severed scrap material against the downwardly rotating anvil, the scrap will tend to be ejected from the die assembly at a trajectory that is angled significantly lower than the exit trajectory of the processed corrugated board product. The ability to consistently and reliably ensure that the cut scrap material will exit the die assembly with a significantly lower trajectory than the product material, results in an improved, efficient and cost-effective die cutting operation.

To achieve this, the present invention provides a resilient rubber type scrap stripper that includes a base that is secured to the die board and an angled flexible finger integral with the base and extending outwardly therefrom. The finger, in a non-compressed position, extends at an angle outwardly past the terminal edge of any adjacently disposed scrap blades. During the die cutting operation, the scrap stripper is disposed between the rotary cutting die and the corrugated board product being passed between the anvil and the rotary cutting die. As the scrap stripper enters the nip between the die board and the anvil, the entire stripper, including the base and the angled finger, is compressed such that adjacently disposed scrap blades cut selected pieces of scrap from the corrugated board blank passing through the nip. As the scrap stripper exits the nip, it finds itself still disposed between a cut scrap piece and the cutting die. However, as the scrap stripper exits the nip, the same will expand and as it expands, it will strip the underlying piece of cut scrap from the adjacent blade or blades. In addition, the angled finger that forms a part of the scrap stripper will tend to extend and in this process, the flexible angled finger will engage and push the cut scrap piece against the underlying and rotating anvil. The ability of the angled finger to extend substantially beyond the height of the scrap blade or blades, enables the flexible finger to hold the cut scrap piece against the anvil on the downstream side of the nip. This, it follows, causes the cut scrap to be separated from the corrugated board product and to be directed generally downwardly alongside the downstream side of the anvil.

It is therefore an object of the present invention to provide a rotary cutting die that will effectively separate cut scrap from corrugated board product.

Still a further object of the present invention is to provide a scrap stripper for a rotary cutting die that is extendable substantially past the height of an adjacent scrap cutting blade for holding exiting scrap pieces against a cooperating anvil in order that the anvil may effectively control the flight or trajectory of the scrap piece exiting the nip between the die board and the anvil.

Other objects and advantages of the present invention will become apparent and obvious from a study of the following description and the accompanying drawings which are merely illustrative of such invention.

DETAILED DESCRIPTION OF THE INVENTION

Figure 1:
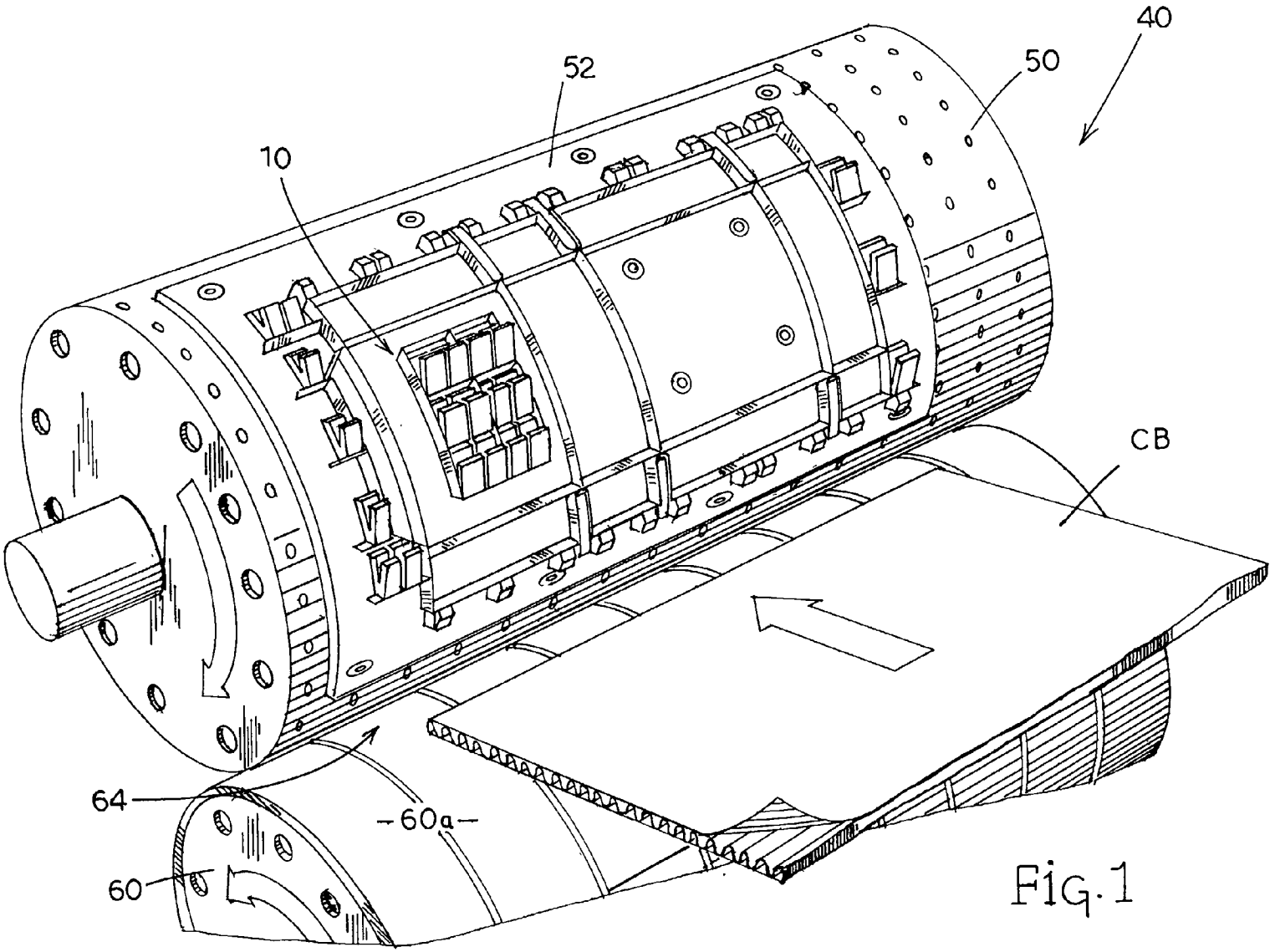
FIG. 1 is a perspective view of a corrugated board rotary die cutting apparatus which incorporates resilient scrap strippers of the type contemplated by the present invention.

With further reference to the drawings, FIG. 1 illustrates a rotary die cutting apparatus, indicated generally by the numeral 40, for cutting corrugated board CB. The rotary die cutting apparatus 40 basically comprises a pair of rotatably mounted, cooperating cylinders or drums. More particularly, the assembly includes a cutting cylinder 50 and an anvil cylinder 60. Cutting cylinder 50 is at least partially surrounded or sheathed with a generally cylindrical die board or base 52. Secured around the anvil 60 in conventional fashion is a layer of neoprene rubber 60*a*, or other suitable material, against which the die board 52 cuts.

Typically, the cutting cylinder 50 and anvil cylinder 60 are disposed closely adjacent each other so as to define a nip or nip area 64 between the cylinder and anvil. In a conventional corrugated board die cutting operation, the cutting cylinder 50 and anvil cylinder 60 are driven at essentially the same speed and sheets of corrugated board CB are fed through the nip 64. As the corrugated board CB is fed through the nip, the cylindrical die board 52 cuts through the corrugated board and against the outer cylindrical sheet of neoprene rubber 60*a* secured to the anvil cylinder 60. Thus in conventional fashion, the sheets of corrugated board are trimmed, scored, slitted, etc. so as to produce a sheet or blank of corrugated finished product along with cut scrap.

In order to produce the corrugated board product, the rotary cutting die board 52 is typically provided with a series of knives or blades and scoring rules that trim, cut and score selective areas of the corrugated board fed into and through the nip 64. Note in FIG. 1, for example, that the cylindrical die board 52 does include various blades and/or scoring rules. In addition, the cutting die board 52 includes various trim and scrap strippers and could include product ejectors as well (It should be pointed out that the die board 52 in FIG. 1 does not show product ejectors but that such are typically incorporated into die board designs). The trim and scrap strippers typically function to strip cut trim or scrap from adjacently disposed cutting blades. The product ejectors act to eject the final corrugated product from certain blades that extend from the cutting die 52.

The present invention deals with scrap strippers. More particularly, the die board 52 is provided with a series or array of scrap strippers, some of which are aligned along opposed outer sides of the die board 52 while a group of nine such scrap strippers are disposed within the confines of a rectangular blade network that is effective to cut a rectangular slot or opening from a sheet of incoming corrugated board. FIGS. 2 and 3*a*–3*c* show in detail the design of the scrap strippers secured to the cutting die 52. In these drawings, the scrap stripper is indicated generally by the numeral 10.

Viewing the scrap stripper 10 in more detail, it is seen that the same assumes a generally V-shape and includes a base 12 and a flexible angled finger 22. Base 12 includes a pair of vertical sides 14, a horizontal bottom or mounting surface 16, a generally horizontal inner surface 18, and an angled rear edge surface 20. The flexible finger 22 includes a pair of vertical sides 24, an angled contact surface 26, an angled inner surface 28 and an angled rear edge surface 30. The base 12 and flexible finger 22 are joined at an angle so as to form a generally V-shaped structure. In fact, in the embodiment illustrated herein, the finger 22 and base 12 merge and together they form a leading or forward edge 32. A generally wedge-shaped space or relief area is formed between the base 12 and the angled flexible finger 22.

Figure 3A:
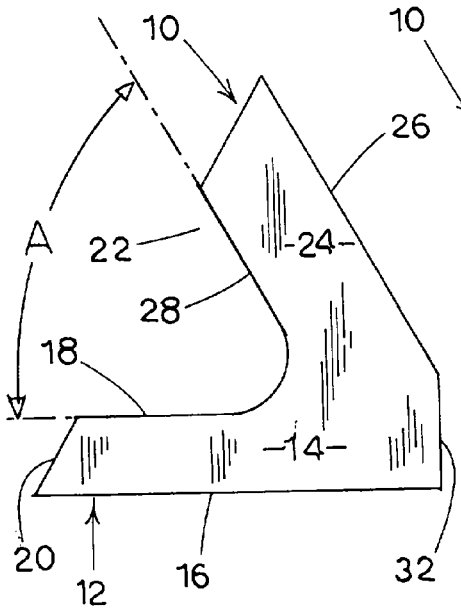
FIG. 3A is a side elevational view of the resilient scrap stripper of the present invention.
Figure 3B:
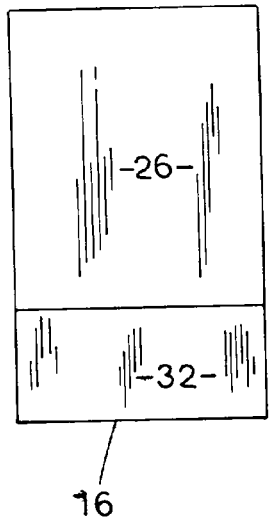
FIG. 3B is a front elevational view of the resilient scrap stripper of the present invention.
Figure 3C:
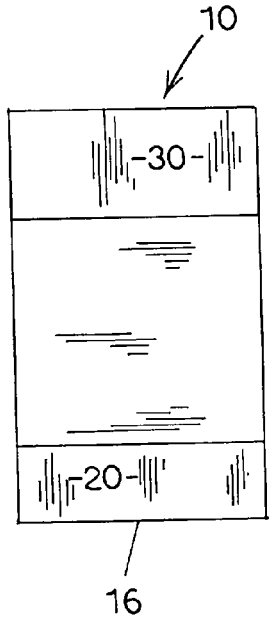
FIG. 3C is a rear elevational view of the resilient scrap stripper of the present invention.

As seen in FIG. 3A, finger 22 and base 12 form an angle that is referred to as angle A. Angle A in one preferred embodiment is approximately 30–75 degrees. But it should be appreciated that angle A could vary depending on the application and structural characteristics of the material from which the stripper 10 is constructed.

It should be appreciated at this point that, although the stripper 10 is described herein in terms of a discrete base segment 12 and a discrete finger segment 22, in practice the stripper 10 would typically be fabricated utilizing a one-piece molding or machining type process, such that these segments are continuous. Furthermore, in the embodiment contemplated herein, the stripper would typically be fabricated of a 25–60 durometer closed cell rubber polymer, such as neoprene, although other materials exhibiting satisfactory elastic or resilient properties could be employed. Preferably, it is believed that a durometer of approximately 40 would impart to the stripper sufficient hardness and flexibility to perform its intended functions.

With particular reference to the sequence of drawings illustrated in FIGS. 4A–4F, a pair of scrap strippers 10 are shown therein and the sequence of views illustrates the movement of the strippers along with a sheet of corrugated board CB through the nip 64 defined between the cutting cylinder 50 and the anvil 60. To illustrate the operation of the scrap strippers 10, only two are shown in FIGS. 4A–4F. Along with the pair of strippers 10, there is shown a pair of scrap cutting blades 54 and 56. Cutting blades 54 and 56 function to cut a piece of scrap S from the corrugated board CB being fed into the nip 64. It will be appreciated by those skilled in the art, that the scrap strippers 10 can be employed individually on the die board 52 or can be employed in groups such as with the group of nine strippers shown about the left-hand side of the die board 52 in FIG. 1. Further, the scrap cutting blades could surround the one or more scrap strippers 10 to effectively cut a hole, notch or even a trim piece from the corrugated board CB passing through the nip 64. Again, for purposes of illustration, in the sequenced views of FIGS. 4A–4F, only two scrap cutting blades are shown, the leading scrap blade 54 and the trailing blade 56.

Figure 4B:
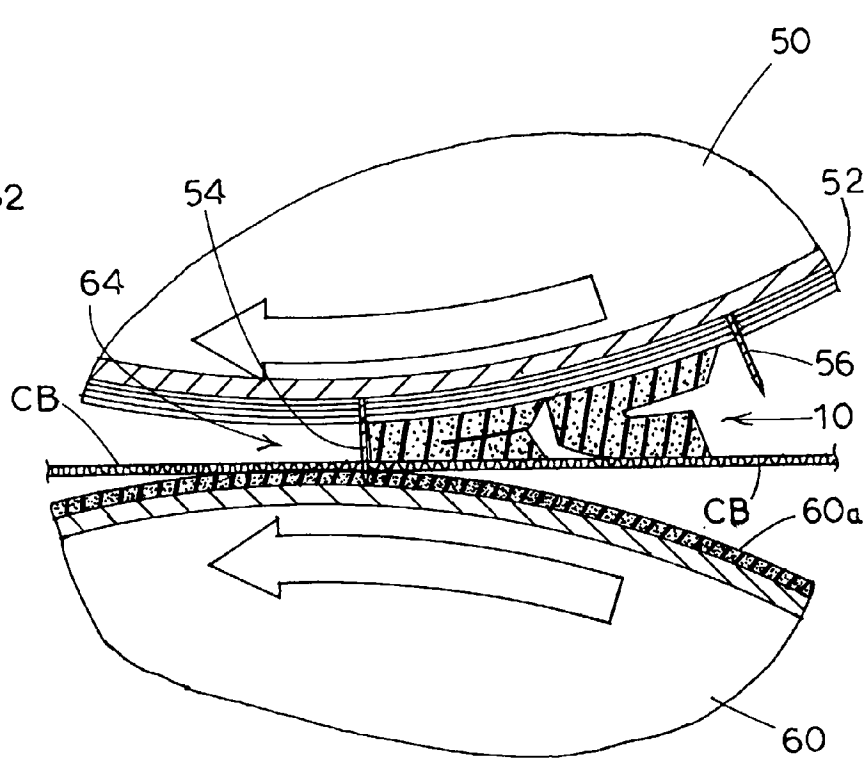
FIG. 4B is a partial sectional view similar to FIG. 4A but which illustrates a leading scrap stripper entering the nip between the rotary cutting die and the anvil.
Figure 4A:
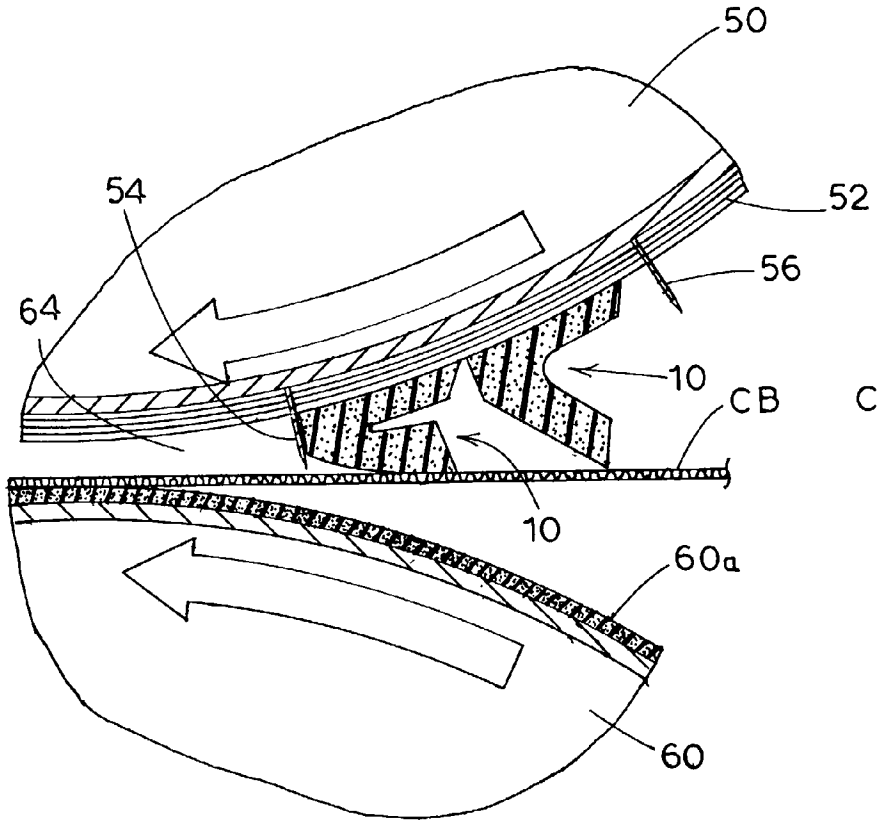
FIG. 4A is a partial sectional view of a corrugated board rotary die cutting apparatus incorporating the resilient scrap strippers of the present invention and which illustrates the relative positioning and orientation of the scrap strippers and incoming blank of corrugated board material prior to cutting.

Now, viewing FIG. 4A particularly, it is seen that the corrugated board CB has been fed into the nip 64 and the two scrap strippers 10 are being turned clockwise and are about to approach the nip 64. In FIG. 4A, neither blade 54 or 56 has engaged the corrugated board CB but the finger portion of the lead scrap stripper 10 has engaged the corrugated board CB and has started to flex inwardly towards the base of the stripper. In the case of the trailing scrap stripper 10, the finger appears to be fully extended but has just reached the point where the outer terminal end of the finger has engaged the corrugated board CB.

In FIG. 4B, the lead scrap blade 54 has engaged and cut through the corrugated board CB. The lead scrap stripper 10 has been further compressed between the die board 52 and the corrugated board CB to such an extent that the flexible finger portion lies adjacent the base. In addition, with respect to the trailing scrap stripper 10, the finger portion has fully engaged the corrugated board CB and has been flexed back and inwardly to an intermediate compressed or retracted position. Trailing scrap blade 56 remains spaced from the corrugated board CB.

Figure 4D:
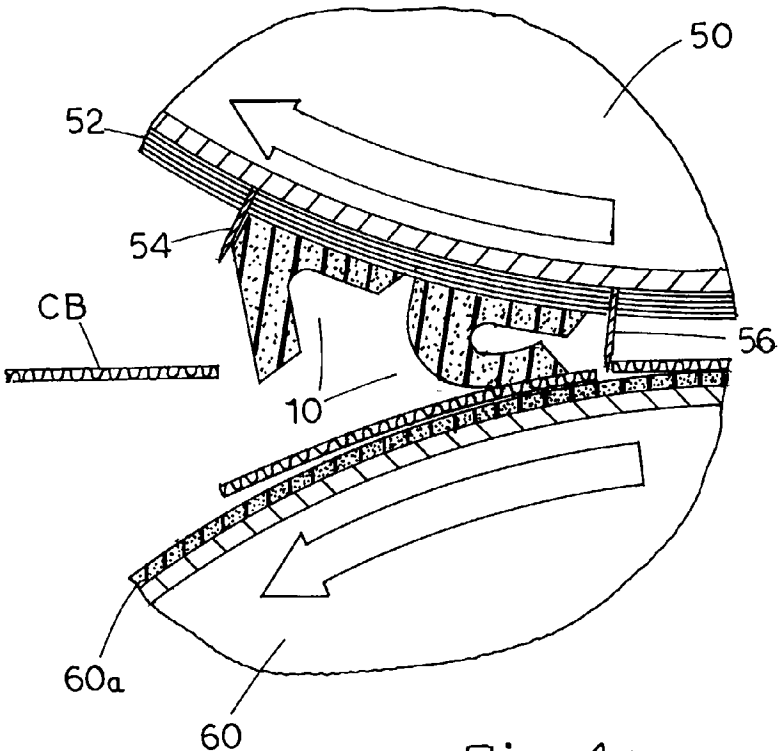
FIG. 4D is another sequence view of the rotary die cutting apparatus incorporating the resilient scrap strippers of the present invention, which illustrates the recoiling action of a trailing scrap stripper as it holds the severed scrap against a downwardly rotating anvil cylinder.
Figure 4C:
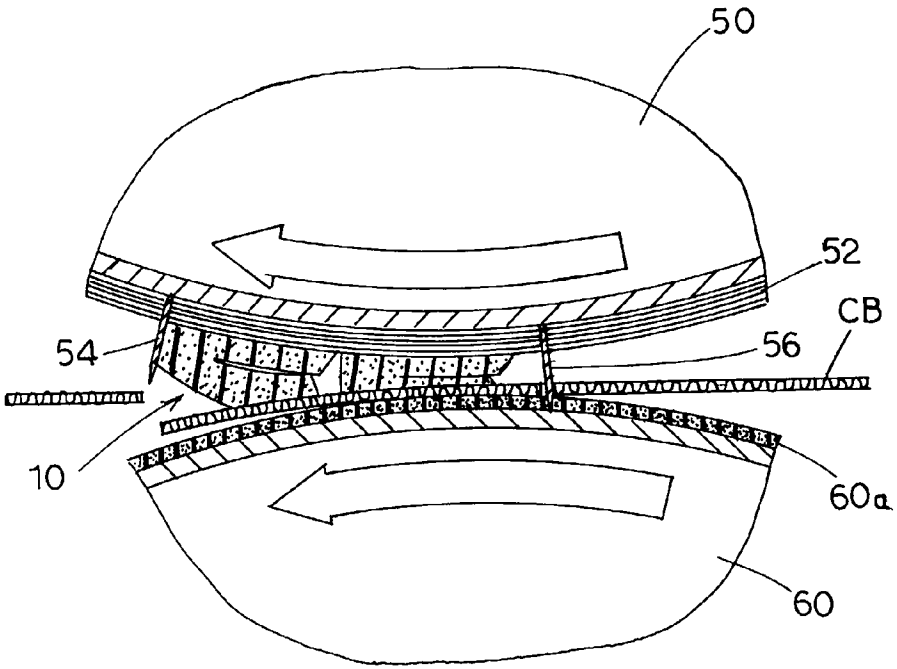
FIG. 4C is another sequence view illustrating a pair of scrap strippers being compressed between the die board and a cut piece of scrap as the scrap strippers move through the nip.

Turning to FIG. 4C, the lead scrap blade 54 has completed its cutting operation and has disengaged itself from the corrugated board CB. The finger of the lead stripper 10 has started to exert a downward or outer force on the underlying scrap piece S and, as viewed in FIG. 4C, has already acted (alone or in convert with other strippers) to strip the scrap piece S from the lead scrap blade 54. The trailing scrap stripper 10 is disposed squarely within the nip 64 defined between the cutting cylinder 50 and the anvil 60. It is substantially compressed between the die board 52 and the scrap piece S. At the same time, the trailing scrap blade 56 has rotated sufficiently clockwise to engage the corrugated board CB and to cut through the same so as to separate the rear portion of the scrap piece S from the trailing portion of the corrugated board CB.

In FIG. 4D, it is seen that the cutting cylinder 50 and anvil 60 have rotated clockwise to a point where both blades 54 and 56 are separated from the corrugated board CB and there is produced a cut scrap piece S. Also at this point, the leading scrap stripper 10 has assumed its normal erect or extended position and is completely separated from the corrugated board CB and the scrap piece S. However, the trailing scrap stripper 10 remains engaged with the scrap piece S and acts to hold the scrap piece S against the rubber layer 60*a* formed about the outer portion of the anvil 60. In particular, the finger portion of the trailing stripper 10 has moved and flexed outwardly from the position shown in FIG. 4C, and while the finger portion of the trailing stripper has not reached a fully extended position, it nevertheless lies flush against a trailing or rear portion of the scrap piece S and holds the scrap piece S against the rotating anvil 60. Thus it is appreciated that as viewed in FIG. 4D that the cooperative actions of the scrap strippers at this point in the cycle have already started to separate the scrap piece S from the corrugated board product that is being directed generally horizontally and outwardly from the nip 64 defined between the cutting cylinder 50 and the anvil 60.

Figure 4F:
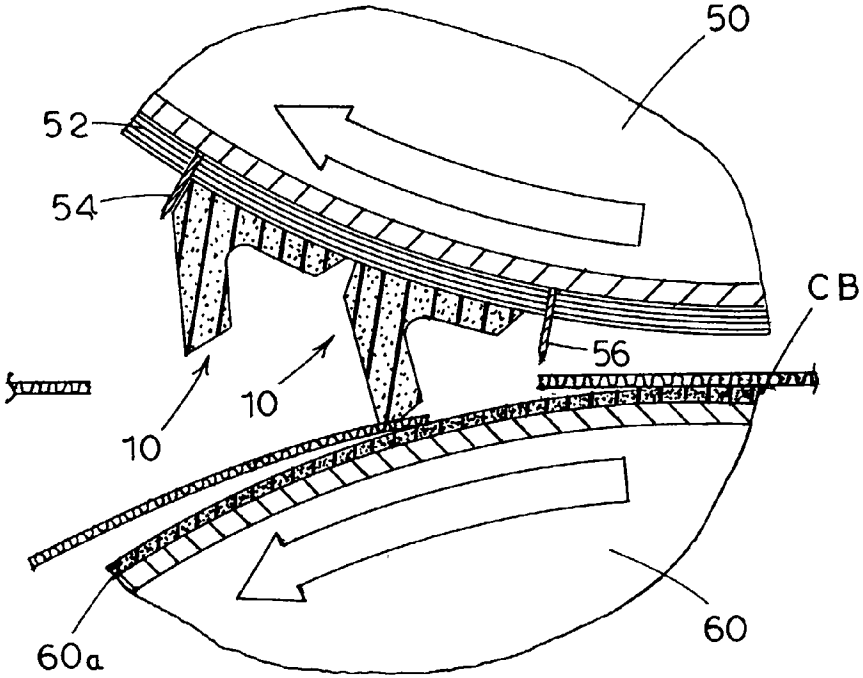
FIG. 4F is a final sequence view showing the trailing scrap stripper engaging a trailing portion of the severed scrap piece and continuing to hold the trailing portion of the scrap against the anvil.
Figure 4E:
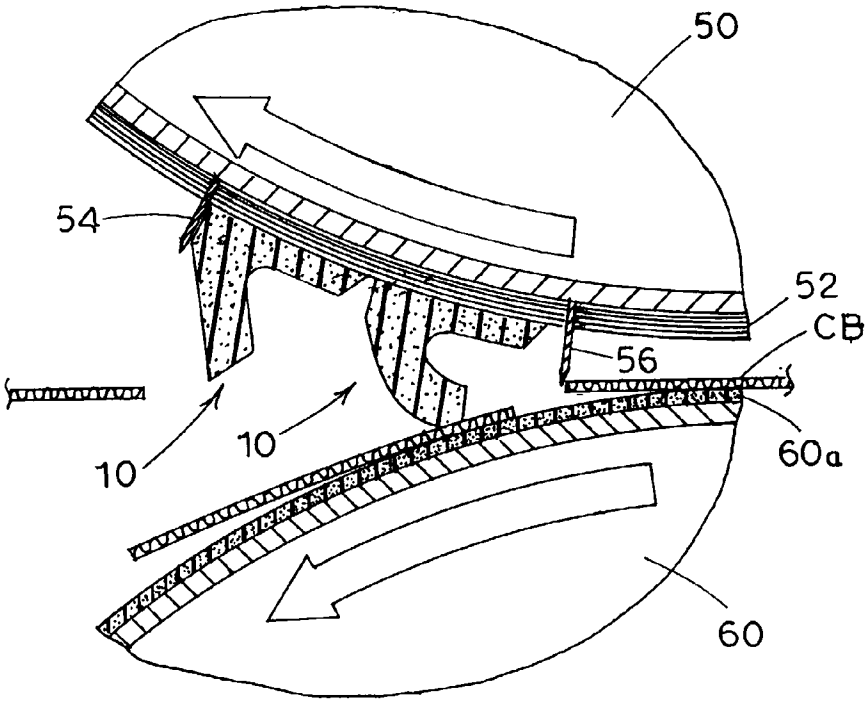
FIG. 4E is another sequence view of the rotary die cutting apparatus incorporating the resilient scrap strippers of the present invention, which illustrates the further recoiling action of the trailing stripper as it continues to hold the severed scrap against a downwardly rotating anvil cylinder following clearance of the lead scrap stripper.

Turning to the next sequence drawing, FIG. 4E shows that the cutting cylinder 50 and the anvil 60 have both advanced from the position shown in FIG. 4D. However, the flexible finger of the trailing scrap stripper 10 still remains in contact with the trailing portion of the scrap piece S.

Finally, FIG. 4F shows the trailing scrap stripper 10 being disposed in a fully erect or extended position but with the terminal end of the flexible finger still being engaged with the trailing portion of the cut scrap piece S. It is thusly seen from FIG. 4F, that the trailing scrap stripper 10 acts to continuously engage the cut scrap piece S and to hold the scrap piece against the anvil 60 for a significant period, even after the trailing stripper 10 has exited the nip 64. This results in the scrap piece S being held against the anvil 60 for a certain period of time after the scrap piece S/has exited the nip 64. Consequently, by holding the scrap piece S against the anvil 62, the cut scrap pieces are directed generally downwardly adjacent the downstream side of the anvil and in the process, the scrap pieces are separated from the corrugated board product which typically is ejected along a generally horizontal path from the nip 64.

From the foregoing specification and discussion, it is appreciated that the scrap stripper 10 performs two basic functions. First, the stripper 10 acts to strip cut scrap pieces S from one or more adjacently disposed knife or blade segments. Secondly, because of the configuration of the stripper 10 and its ability to extend substantially past the height of any adjacent blades, the stripper through the flexible finger 22, acts to engage the cut pieces of scrap S and to hold the scrap pieces against the anvil 60 as the scrap pieces move out of the nip. Due to the extension of the finger 22, the scrap pieces S are held against the anvil for a substantial period after the scrap pieces S have been cut.

By holding the scrap pieces S against the anvil, it follows that the scrap pieces acquire a significant downward velocity component that directs the scrap downwardly adjacent the downstream side of the anvil. Thus, the strippers 10 generally assure that the scrap pieces are not directed horizontally out of the nip which, in such case, the scrap would become intermingled and mixed with the finished corrugated board product produced by the rotary cutting die assembly 40.

Further, the design of the stripper 10 allows it to perform both of the above functions effectively and efficiently. Because of the flexible nature of the finger 22, it can be pressed or pushed backwards, relative to the direction of travel of the die board 52, against the base 12 of the stripper and both the finger and base can be compressed simultaneously, resulting in the storing of energy in the compressed stripper. Once released, both the finger 22 and base 12 can expand or recoil with sufficient energy and force to push the cut scrap pieces S from any adjacent blades. Thereafter, the finger 22 can continue to extend and maintain contact with the underlying scrap piece S and, in the process, hold the scrap piece S against the anvil 60 such that the anvil will act to separate the scrap from the corrugated board product.

Figure 5:
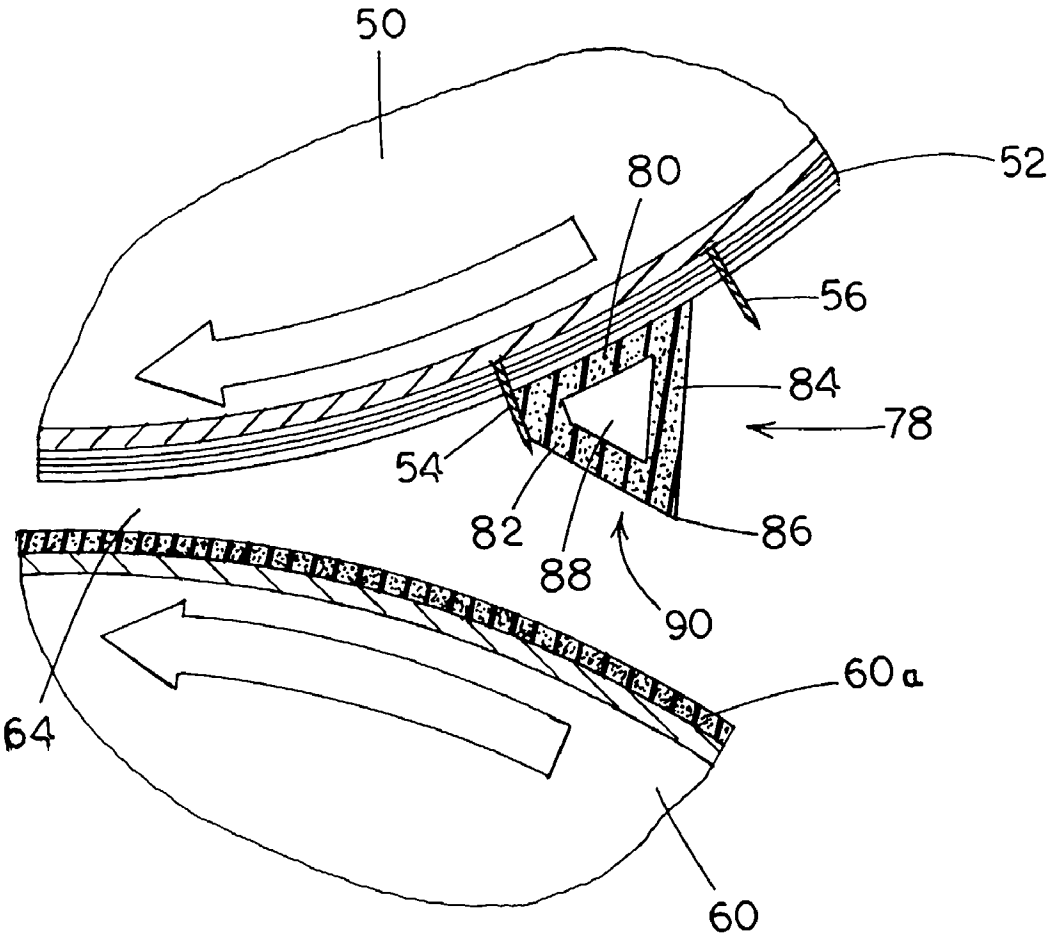
FIG. 5 is a fragmentary schematic view of a rotary cutting die showing an alternative embodiment for the scrap stripper of the present invention.

Turning to FIG. 5, there is shown therein an alternative design for the scrap stripper. This alternative design comprises a resilient scrap stripper which is indicated generally by the numeral 78. Scrap stripper 78 is, like the scrap stripper discussed above, constructed of a compressible resilient material. Basically scrap stripper 78 comprises a base 80 and an outer flexible portion that is indicated generally by the numeral 90. In the embodiment of FIG. 5, the outer flexible portion 90 includes a pair of legs 82 and 84 that extend outwardly from the base and meet to form an apex 86. Defined within the confines of the base 80 and the legs 82 and 84 is a relief area 88.

Figure 2:
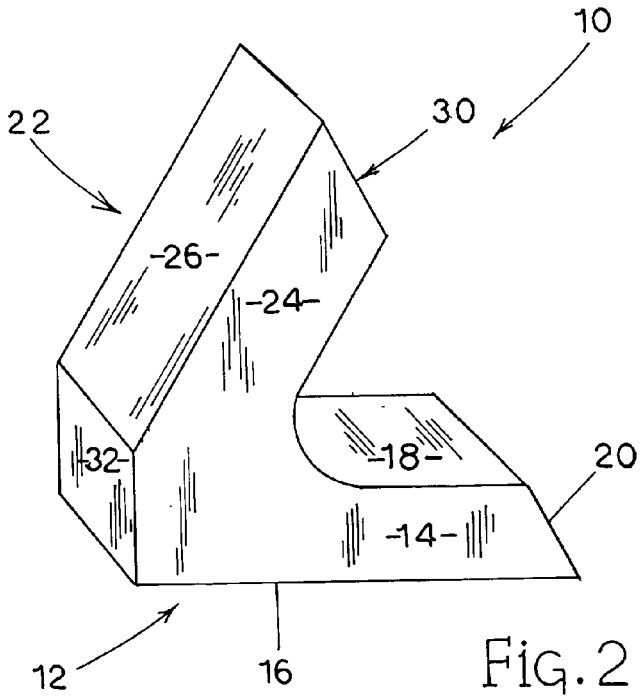
FIG. 2 is a perspective view of the resilient scrap stripper of the present invention.

Scrap stripper 78 (FIG. 5), like the scrap stripper 10 shown in FIG. 2, is designed to be mounted to the board or base 52 that forms a part of the rotary cutting die. In particular, as illustrated in FIG. 5, base 80 is designed to be secured by glue or other suitable means to the board or base 52. In addition, the scrap stripper 78 is adapted to be situated adjacent or between a series of knives 54 and 56. It is important to appreciate that the scrap stripper 78 functions substantially the same as the scrap stripper 10 discussed above and shown in FIGS. 1 through 4F. In particular, the outer flexible portion 90 of the stripper is designed such that it can be compressed between the rotary cutting die and anvil as it passes through the nip defined between the cutting die and the anvil. In particular, as viewed in FIG. 5, the forward leading leg 82 would tend to be compressed towards the die board 52 in a direction generally opposite to the direction of rotation of the cutting die and the anvil. Effectively, the relief area 88 defined within the scrap stripper 78 permits the outer portion 90 to be compressed to where the entire scrap stripper 78 would lie in a compressed state within the nip between the cutting die and the anvil. As the scrap stripper 78 exits the nip, the leading leg 82, along with the trailing leg 84, would tend to expand and project outwardly from the base and in that process would engage a cut piece of scrap and push the same against the anvil in the same manner discussed above with respect to the scrap stripper 10 shown in FIG. 2.

Also, the efficiency of the scrap strippers disclosed herein may be enhanced by selectively weighting certain portions of the strippers. This is because in operation the centrifugal force associated with the stripper tends to force portions of the stripper outwardly as the stripper exits the nip between the cutting die and the anvil. By selectively adding additional weight in certain areas of the stripper, the positive effect of this centrifugal force is substantially increased.

The selective weighting of the scrap strippers can be carried out in a number of ways. For example, the material making up the scrap stripper may comprise a dual durometer material, meaning that one portion of the stripper would be more dense and consequently heavier than another portion. For example, in the case of the design shown in FIG. 2, the entire flexible finger 22 or a portion thereof could be selectively weighted by a strip of material having a heavier density than the material making up other portions of the stripper. Another example of weighting the stripper of FIG. 2 would entail placing small weighted pellets or balls in the outer terminal end of the flexible finger. The same approach would apply to the stripper 78 shown in FIG. 5. The net effect of selectively weighting the stripper is that the portion of the stripper that engages the cut scrap would impart additional force to the cut scrap and consequently would eject and control the trajectory of the cut scrap more efficiently.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A method of cutting corrugated board passing between a rotary cutting die and an anvil, stripping one or more cut scrap pieces from a scrap cutting blade, and directing the cut scrap from the cutting die and anvil, comprising;

(a) directing a sheet of corrugated board through a nip area defined between the cutting die and anvil;

(b) cutting one or more scrap pieces from the corrugated board as it passes through the nip;

(c) utilizing a scrap stripper having a base and a flexible, angled finger to strip the cut scrap piece from the scrap blade and to control the direction of movement of the scrap piece as the scrap piece exits the nip, and wherein the flexible finger is integral with the base and extends outwardly over the base at an acute angle with respect to the base such that an opening is defined between the angled finger and the base;

(d) compressing the scrap stripper between the cutting die and the scrap piece by bending and compressing the finger against the base, closing the opening existing between the angled finger and the base, and compressing both the finger and bass as the scrap stripper moves through the nip;

(e) expanding the scrap stripper as the scrap stripper moves from the nip and engaging the cut scrap piece and stripping the cut scrap piece from the scrap cutting blade; and (f) extending the flexible finger outwardly as the scrap stripper moves from the nip and engaging the cut scrap piece with the extended finger and holding the cut scrap piece against the anvil with the finger such that the anvil tends to direct the cut scrap piece away from the nip and away from the cutting die and anvil.

2. The method of claim 1 wherein the finger normally extends outwardly past the scrap cutting blade when it assumes a normal non-compressed posture and wherein when the scrap stripper assumes a fully compressed position both the finger and base are compressed such that together they do not extend past the height of the scrap cutting blade.

3. The method of claim 2 wherein the scrap stripper is oriented such that the finger thereof, when extended, extends in a general direction opposite a direction of travel of the die cutting board.

4. The method of claim 1 wherein the angle formed between the base and the finger is approximately 30–75 degrees.

5. A rotary cutting die for cooperating with a rotary anvil to cut corrugated board comprising:

(a) a base;

(b) at least one scrap cutting blade secured to the base of the cutting die for cutting a piece of scrap from a sheet of corrugated board that is directed through a nip defined between the cutting die and the anvil;

(c) at least one scrap stripper mounted to the base adjacent the blade for stripping a cut scrap piece from the blade and for urging the cut scrap piece against the anvil as the cut scrap piece exits the nip;

(d) at least one scrap stripper being constructed of a resilient and compressible material and including a base, and a flexible finger integral with the base and extending outwardly over the base and at an acute angle with respect to the base such that an opening is defined between the angled finger and the base;

(e) wherein the flexible finger is movable between a retracted position where the finger lies adjacent the base and an extended position where at least a portion of the finger is separated from the base; and (f) wherein in the retracted position the finger and base are both compressed.

6. The rotary cutting die of claim 5 wherein the finger forms an acute angle of approximately 30–75 degrees with the base.

7. The rotary die cutting board of claim 5 wherein the die cutting is designed to rotate in a certain direction and wherein the finger is angled away from said direction.

8. The rotary cutting die of claim 5 wherein in the retracted position the finger assumes a compressed state and when compressed, the finger is pushed into contact with the base such that both the finger and base can be compressed together in response to the scrap stripper passing through the nip between the die cutting board and the anvil.

9. The rotary cutting die of claim 5 including a plurality of the scrap strippers particularly placed on the base to engage one or more cut scrap pieces and strip the one or more scrap pieces from one or more adjacent blades.

10. The rotary cutting die of claim 5 wherein prior to entering the nip, the scrap stripper assumes an erect position and upon entering the nip, the finger is closed adjacent the base and the finger and base are compressed together, and upon moving from the nip both the base and the finger expand and the finger separates from the base and moves outwardly towards the erect position and in the process the finger engages and holds the cut piece of scrap adjacent the anvil such that the anvil acts to direct the cut scrap away from the die cutting board and anvil.

11. The rotary die cutting of claim 5 wherein the scrap stripper is constructed of a closed cell rubber material having a durometer of approximately 25–60.

12. A rotary cutting die for cooperating with a rotary anvil to cut corrugated board comprising:

(a) a base;

(b) at least one scrap cutting blade secured to the base of the cutting die for cutting a piece of scrap from a sheet of corrugated board that is directed through a nip defined between the cutting die and the anvil;

(c) at least one scrap stripper mounted to the base adjacent the blade for stripping a cut scrap piece from the blade and for urging the cut scrap piece against the anvil as the cut scrap piece exits the nip;

(d) at least one scrap stripper being constructed of a resilient and compressible material and including a base, and a flexible finger integral with the base and extending outwardly over the base and at an acute angle with respect to the base such that an opening is defined between the angled finger and the base;

(e) wherein the flexible finger is movable between a retracted position where the finger lies adjacent the base and an extended position where at least a portion of the finger is separated from the base; and (f) and wherein the finger of the scrap stripper in the extended position assumes a straight configuration.

* * * * *